United States Patent [19]

Wurfel

[11] 4,123,349

[45] Oct. 31, 1978

[54] SEPARATION OF SOLIDS CONTAINING RESIDUES FROM LIQUID FRACTIONS OF A COAL HYDROGENATION PROCESS USING AN EXPANSION ENGINE AND A PRESSURE RELEASE MEANS

[75] Inventor: Helmut Wurfel, Niederwurzbach, Germany

[73] Assignee: Saarbergwerke Aktiengesellschaft, Saarbrucken, Germany

[21] Appl. No.: 802,517

[22] Filed: Jun. 1, 1977

[30] Foreign Application Priority Data

May 22, 1976 [DE] Fed. Rep. of Germany ..... 2623022

[51] Int. Cl.[2] ..... C10G 1/08; C10G 37/04; B01D 3/06

[52] U.S. Cl. ..... 208/10; 208/9; 208/102; 208/364; 208/366

[58] Field of Search ..... 208/9, 10, 102, 364, 208/366

[56] References Cited

U.S. PATENT DOCUMENTS

| | | | |
|---|---|---|---|
| 3,844,928 | 10/1974 | Geymer | 208/10 |
| 4,019,975 | 4/1977 | Urquhart | 208/10 |

FOREIGN PATENT DOCUMENTS

| | | | |
|---|---|---|---|
| 280,734 | 11/1927 | United Kingdom | 208/10 |

*Primary Examiner*—Delbert E. Gantz
*Assistant Examiner*—J. Thierstein
*Attorney, Agent, or Firm*—M. Ted Raptes

[57] ABSTRACT

A process for the separation of solids containing residues from a liquid fraction containing higher boiling fractions produced in a coal hydrogenation process at elevated temperatures and pressures. The separation process involves two expansion steps, one step in an expansion engine and a subsequent expansion-evaporation step in a pressure release means and a separator chamber, whereby the higher boiling fraction is evaporated and separated from the residue fraction. The separation process in the chamber can be facilitated by creating vacuum conditions therein, or by introducing a foreign gas, preferably heat exchange with the removed hot residue fraction, to thereby reduce the partial pressure of the evaporated higher boiling fraction. The foreign gases can be steam or/and gases obtained from the hydrogenation of the coal.

8 Claims, 2 Drawing Figures

SEPARATION OF SOLIDS CONTAINING RESIDUES FROM LIQUID FRACTIONS OF A COAL HYDROGENATION PROCESS USING AN EXPANSION ENGINE AND A PRESSURE RELEASE MEANS

BACKGROUND OF THE INVENTION

This invention relates to a process for the separation of solids containing residues from a product. The invention particularly relates to a process for the hydrogentation of coal at elevated temperatures and pressures, wherein various product fractions such as the lower boiling product fractions are separated, and specifically wherein a solid containing residues fraction is separated from a fraction containing the higher boiling product components. The separation process comprises pressure release and the subsequent sepration of the phases of the product fraction.

In the process for the catalytic hydrogenation of coal under elevated pressures and temperatures, a product is obtained which comprises gaseous and liquid components including hydrogen, lower boiling hydrocarbon components, steam, liquid ditillation oils, as well as carbon, unreacted coal residues, catalyst particles, and sticky asphalt-like substances. The separation of the gaseous and lower boiling hydrocarbon components from the product is relatively simple. However, difficulties are encountered in the separation of the higher boiling liquid distillation oils from the remaining solids containing hydrogenation residues and sticky asphalt like substances. In convention distillation procedures and equipment for the separation of the distillation oils from the residues, considerable incrustations and depositions of sticky asphalt-like substances are formed on the equipment in relatively short periods of time. In addition, the asphalt-like substances have coking tendencies and during the distillation process can be coked, whereby the distillation equipment is further fouled.

It has been previously proposed to eliminate the distillation procedures and equipment for the separation of the distillation oils from the solids containing residues, and to use a pressure release evaporation procedure, whereby the released distillation oils in the form of gaseous vapors are subsequently removed. This evaporation procedure involves the release of the high pressure and temperature (e.g. about 250 bar and 450° C.) from the product fraction containing the solids containing residues and the distillation oils. The pressure release of the fraction to the ambient atmospheric pressure is accomplished by means of throttle valves, and the evaporated gaseous vapors fraction is subsequently submitted to phase separation in conventional separating means. By this procedure, it is possible to remove the major portion of the distillation oils in the form of gaseous vapors, and to obtain a concentrated remaining fraction of the predominantly solids containing hydrogenation residues.

Although the above evaporation procedure appears to attain the desired result, there are considerable disadvantages encountered. Particularly bothersome is the fact that the throttle valves become inoperative in a relatively brief period of operating time due to the large differentials of pressures handled and also due to the pressure of the solids components in the fraction being handled.

BRIEF SUMMARY OF THE INVENTION

An object of this invention is to provide a process for separating solids containing hydrogenation residues from a product fraction produced in a coal hydrogenation process.

A further object of this invention is to provide a process for separating solids containing hydrogenation residues from higher boiling liquid distillation oils.

The objects of this invention are attained in a process of the separation of solids containing hydrogenation residues from higher boiling liquid distillation oils wherein the separation involves at least two steps including a first expansion step in an expansion engine and a second step in a release valve.

DETAILED DESCRIPTION OF THE INVENTION

The process of the present invention is concerned with the separation of various fractions of a product produced in the catalytic hydrogenation of coal. The various fractions of gaseous and liquid components are conventionally separated. However, the troublesome separation of the light distillation oils from solids containing hydrogenation residues in the particular aspect of this invention. Although the process of the invention is especially suitable for separation involved with coal hydrogenation, it is not necessarily limited thereto, but can have application advantageously for the hydrogenation of, for example, tar sands, oil shale, and the like.

Figure 1:
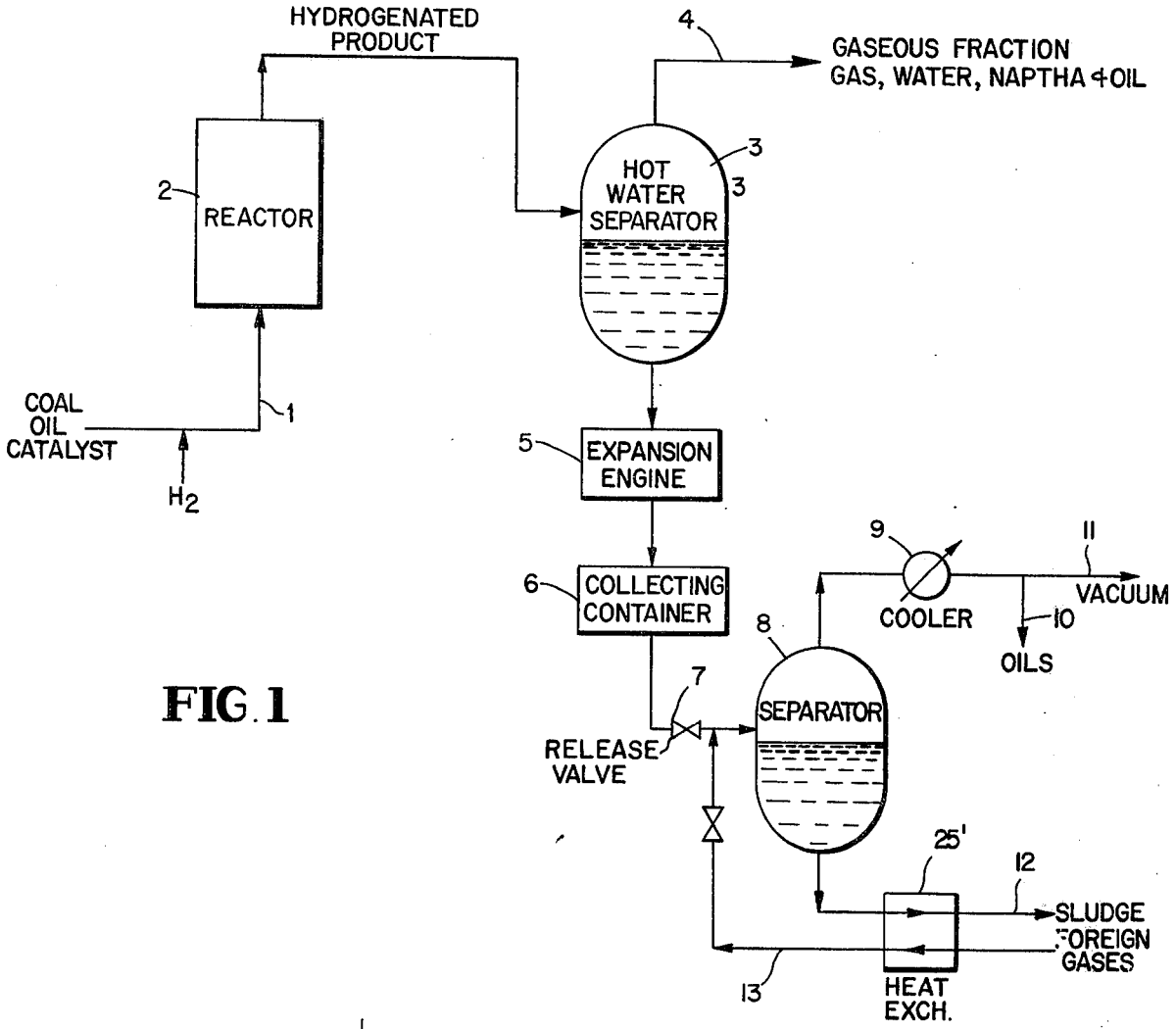
Figure 2:
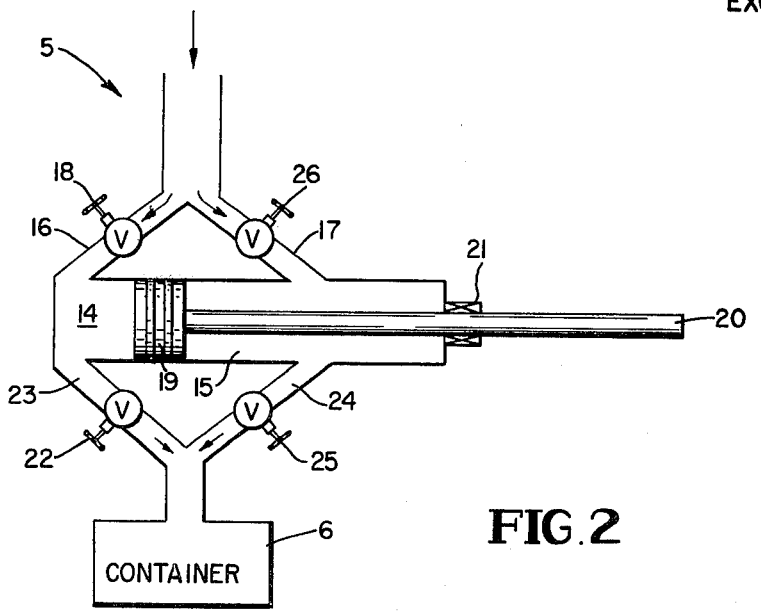

In order to more fully understand the process of this invention reference is made to the accompanying drawing wherein:

FIG. 1 is a schematic flow sheet of a process for the hydrogenation of coal and separation of the various fractions including the separation process of this invention; and FIG. 2 is a shematic representation of an expansion engine used in the separation process of this invention.

Referring to FIG. 1, coal to be conventionally hydrogenated is mixed with oil and a powdered hydrogenation catalyst and is introduced into a hydrogenation reactor 2 through a conduit 1 together with hydrogen at a pressure of about 250 bar. The hydrogenated product leaves the top of the reactor and is introduced into a hot water separator 3, wherein a separation occurs into a gaseous fraction (gas, water, naphtha, oil) which is removed through conduit 4 at the top of the separator 3, and a liquid fraction which contains the solids containing hydrogenation residues and higher boiling distillation oils which is removed through the bottom of the separator 3. The temperature in the hot water separator is about 420° C. and the pressure is about 250 bar.

The liquid fraction is introducted into an expansion engine 5, wherein the pressure of the liquid fraction is lowered from about 250 bar to about 25 bar, at which pressure no evaporation of the distillation oils can occur. The expansion engine 5 removes work energy from the liquid fraction at a pressure of 250 bar by means of the piston rod and transports the liquid fraction to a collecting container 6 at the low pressure of 25 bar. The liquid is removed from container 6 and expanded into a gaseous phase by means of a release valve 7 into a separator 8. The evaporated distillation oils in the gaseous phase are removed from the top of the separator, condensed in cooler 9, and removed for further use by a conduit 10. In accordance with this procedure, the separation of the liquid and gaseous phase in separator 8 is facilitated by lowering the partial pressure of the gaseous oil phase by means of a vacuum conduit 11. The concentrated thickened sludge formed in separator 8 is removed therefrom by means of conduit 12 at a temperature of about 350° C.

In the separation of the phase fractions in separator 8, the lowering of the partial pressure of the gaseous oil phase distilling off to increase the yield in oil vapors, can also be accomplished in another manner than by vacuum means. Thus, a foreign gas can be introduced into the separator 8 which will accomplish the lowering of the partial pressure of the oil vapors. Gases such as hydrogenation gases, and/or steam can be introduced through conduit 13 for this purpose, preferably heated to a higher temperature. The heating can be accomplished by heat exchange with the hot concentrated sludge being removed from the separator in a heat exchanger 25.

Referring now to FIG. 2, the schematic of an expansion engine 5 is depicted which is a double effect piston drive engine. It comprises two working spaces or chambers 14 and 15, two inlet conduits 16 and 17, and two outlet conduits 23 and 24. In the operation thereof for purposes of the initial expansion of the hot liquid fraction from the separator 3, the hot liquid stream first enters from chamber 14 through opened valve 18, whereby the piston 19 is moved to the right producing work energy at the rod 20. The piston rod is sealed against the housing by means of a seal 21 and valves 22 and 26 are closed. When the front chamber 14 is full, the valve 18 closes, valve 22 opens, and valve 26 opens permitting hot liquid to flow into chamber 15 with valve 25 closed. Piston 19 is thereby moved to the left producing work energy in rod 20, and the liquid in chamber 23 is pumped through valve 22 and conduit 23 to container 6. In a repeat of the cycle, piston 19 moves to the right, valves 18 and 25 open and valves 26 and 22 close whereby liquid in chamber 15 is pumped through conduit 24 and valve 25 into container 6.

The process according to the present invention has a number of decided advantages. The initial lowering of the pressure of the liquid fraction in the expansion engine 5 relieves the load on the subsequent release valve 7 to a great extent. Whereas, previous hereto, processes used one relief valve to handle the entire pressure differentials of about 250 bar, now a lowering of the pressure to, for example, about 25 bar can be first accomplished in the expansion engine. Accordingly, the subsequent load on the expansion valve 7 and the corresponding susceptibility to breakdowns is substantially reduced. Even though the enthalpy of the liquid fraction to be expanded by valve 7 is lowered, it is still sufficient to provide the evaporation energy for the distillation oil to be evaporated. Another advantage is the energy available from the expansion engine which can be transformed into mechanical work for other uses, such as the pumping of the reactant materials into the hydrogenation reactor 2. Depending on the efficiency of the expansion engine, up to about 33% of the pumping energy required for the compression of the reactant materials can be recovered.

With respect to the expansion in the expansion engine, it is recommended that the expansion only proceed to the phase limit of the expanding liquid fraction. Accordingly, vapor formation in the engine is avoided, and it is thereby assured that the total enthalpy is retained for the subsequent expansion evaporation. However, it is still possible to produce vapors in the engine by further lowering the pressure and thereby obtain the associated additional work capacity of the vapors. In this situation, it is recommended that the vapors formed be separated from the remaining liquid fraction prior to the subsequent expansion evaporation in release valve 7.

As stated heretofore, the yield of distillation oil during the expansion evaporation can be further increased if the expansion is conducted under vacuum conditions or if within the separator 8, a foreign gas atmosphere is maintained, which reduces the partial pressure of the distillation oil in the separator. The foreign gas atmosphere can be steam and/or a gas fraction recovered during the hydrogenation of the coal. Particularly advantageous for producing the foreign gas atmosphere is the expansion of the foreign gases into the outlet opening of the release valve 7. By so doing, there is produced a thorough contact with the emerging vapor/liquid mixtures from the valve so that a quick equilibrium between evaporating distillation oil vapors and the solids containing hydrogenation residues is established.

What is claimed is:

1. In a process for separation of distillation oils from a liquid product fraction comprising solids containing residues resulting from a hydrogenation process for coal at elevated pressures and temperatures, and from which said product fraction the lower boiling components of said product fraction are separated by expansion and subsequent separation of the phases, the improvement comprising expanding said liquid product fraction in at least two successive steps, a first expansion step effected in an expansion engine in liquid phase wherein no evaporation of said distillation oils occurs, and a second expansion-evaporation step effected in a pressure release means, whereby solids containing residues are separated from said vaporized distillation oils.

2. The process of claim 1, wherein the work energy produced in said expansion step in said expansion engine is used in the form of pumping energy for said hydrogenation process for coal.

3. The process of claim 1, wherein said expansion-evaporation step is conducted under vacuum conditions.

4. The process of claim 1, wherein said expansion-evaporation step is conducted in a chamber containing foreign gases, whereby the partial pressure of said distillation oils is reduced.

5. The process of claim 4, wherein said foreign gases comprise gaseous components from said hydrogenation process for coal.

6. The process of claim 4, wherein steam comprises said foreign gas.

7. The process of claim 4, wherein said foreign gas is introduced directly into the expanded vapor-liquid mixture exiting from said pressure release means.

8. The process of claim 4, wherein said foreign gas is preheated in a heat exchanger with the said solids containing residues removed from said second expansion step.

* * * * *